United States Patent [19]

Francis

[11] Patent Number: 4,603,477

[45] Date of Patent: Aug. 5, 1986

[54] SAFETY RAZORS

[75] Inventor: John F. Francis, Woking, England

[73] Assignee: The Gillette Company, Boston, Mass.

[21] Appl. No.: 698,941

[22] Filed: Feb. 6, 1985

[30] Foreign Application Priority Data

Feb. 27, 1984 [GB] United Kingdom ..... 8405044.

[51] Int. Cl.[4] ..... B26B 21/18; B26B 21/28

[52] U.S. Cl. ..... 30/50; 30/346.56; 30/346.59

[58] Field of Search ..... 30/50, 47, 346.56, 32, 30/77, 78, 346.58, 346.59

[56] References Cited

U.S. PATENT DOCUMENTS

| | | | |
|---|---|---|---|
| 2,108,267 | 2/1938 | O'Neill | 30/346.56 X |
| 2,315,785 | 4/1943 | Greenleaf | 30/50 |
| 3,488,764 | 1/1970 | Welsh | 30/50 |
| 3,494,032 | 2/1970 | Welsh | 30/346.59 |
| 3,505,734 | 4/1970 | Iten | 30/50 X |
| 3,654,701 | 4/1972 | Hastings | 30/346.56 |
| 3,768,162 | 10/1973 | Perry | 30/50 |

FOREIGN PATENT DOCUMENTS

| | | |
|---|---|---|
| 1119767 | 7/1968 | United Kingdom . |
| 1136449 | 12/1968 | United Kingdom . |

*Primary Examiner*—Jimmy C. Peters

*Attorney, Agent, or Firm*—Raymond J. De Vellis

[57] ABSTRACT

In a safety razor having cutting edges directed towards each other across a gap, i.e. an opposed blade razor, the blade edges are each formed with undulating edges. The blade margins are preferably corrugated and the corrugations intersected by planar facets (12), the facets of the two blades being substantially in the same plane (T).

5 Claims, 9 Drawing Figures

SAFETY RAZORS

This invention relates to safety razors of the known form comprising a pair of opposed blade members having respective cutting edges directed towards each other across a gap.

Razors of this general form are known, for example, from British Patent Specification Nos. 1119767 and 1136449, and are used by moving the razor to and fro over the skin in a direction generally perpendicular to the lengths of the cutting edges. Such razors are hereinafter referred to for convenience as "opposed blade razors".

In accordance with a feature of the present invention, the blades of such a razor are each formed with undulating sharpened edges.

In a presently preferred form of the invention, each of the blades has a marginal portion formed with corrugations extending transversely to the edge of the blade and a substantially planar facet intersecting the corrugations over the full depth thereof to define the undulating sharpened edge.

The blade facets are set substantially parallel with each other and, in use of the razor substantially parallel with the skin surface being shaved.

With this arrangement it is found that the razor offers a high degree of safety to the user since each of the blades effectively guards the skin against any tendency for the peaks of the other blade to dig into the skin, and it is found unnecessary in some cases to provide additional cap or guard portions on the razor. At the same time, a high degree of shaving efficiency is achieved, mainly due to the ability of the blades to pick up and sever facial hairs growing in various directions out of the skin. Individual hairs tend to be sliced by the obliquely extending portions of the blade edges.

Some embodiments of the invention will now be described in detail, by way of example, with reference to the accompanying drawings, in which.

Figure 1:
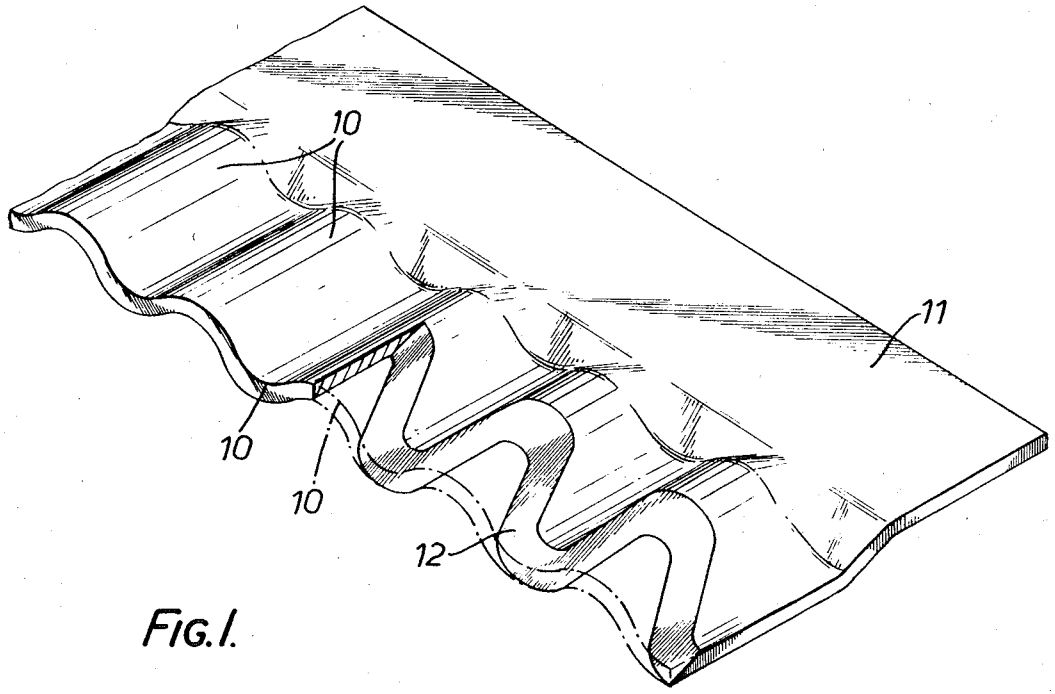
FIG. 1 is a scrap perspective view of the edge of a blade incorporated in razors of the present invention.

The blade edge shown in the drawings is produced by forming a series of corrugations 10 in the marginal portion of a planar blade strip 11. The corrugations extend perpendicular to the edge of the strip and preferably extend equally to opposite sides of the plane of the blade strip 11.

The blade strip is then hardened and then ground by a conventional grinding wheel to form a facet 12 which may be perfectly plane, or it may be formed by the periphery of a grinding wheel, in which case it will be slightly concave, although for practical purposes it may be regarded as substantially planar.

The facet intersects the series of corrugations over the full depth thereof, so as to define an undulating sharpened edge which is co-planar with the facet 12 but which follows the contours of the corrugations.

The edge may be finished by conventional means, for example by electropolishing, to remove grinding burrs and to polish the facet 12.

Figure 4:
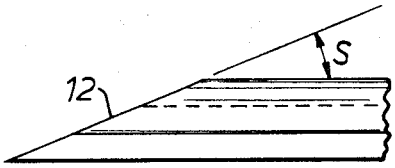
FIG. 4 is an end view of the blade edge form of FIGS. 1 to 3.

In grinding the facet, it is presently preferred to grind away from the edge, i.e. with the periphery of the grinding wheel passing downwardly along the facet 12 as viewed in FIG. 4. This technique has less tendency to damage the sharpened edge. It results in a feathery burr, but this is found to be readily removed by electropolishing.

Figure 2:
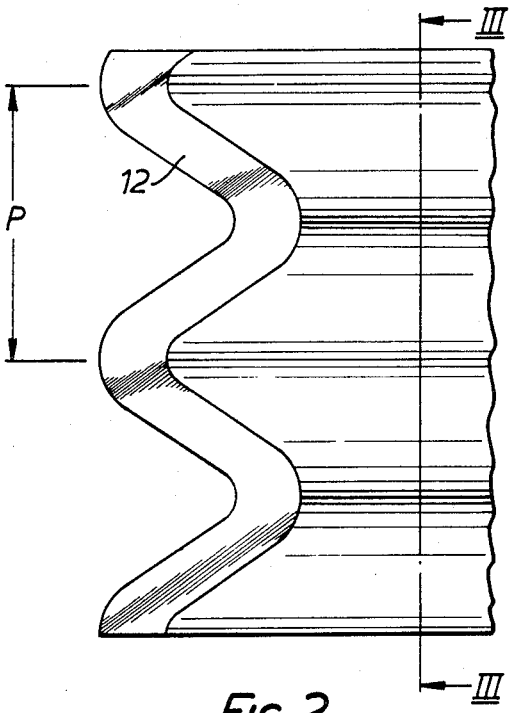
FIG. 2 is a plan view of the blade edge shown in FIG. 1.
Figure 3:
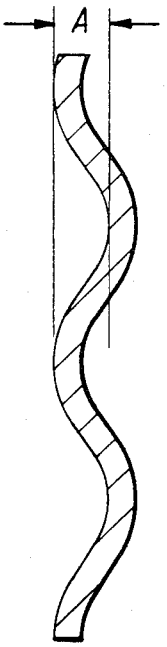
FIG. 3 is a section on the line III—III of FIG. 2.

A wide variety of edge shapes may be derived by variations in the corrugations, particularly with reference to their pitch, amplitude and form. The amplitude ('A' in FIG. 3) may, for example, be 0.15, 0.25 or 0.38 mm and their pitch ('P' in FIG. 2) may be in the order of 0.5 to 2.0 mm.

The corrugations may conveniently be formed by a conventional press-tool, and the same tool may be employed to produce corrugations of different amplitudes by varying the degree of closure of the die and punch.

The corrugations shown are of generally sinusoidal form but they might alternatively be more angular, e.g. of generally V-shape.

The angle ('S' in FIG. 4) between the facet 12 and the plane of the strip may be in the range of 18° to 30°, and preferably between 18° and 25°. The angle 'S' illustrated is $22\frac{1}{2}$°.

Figure 5:
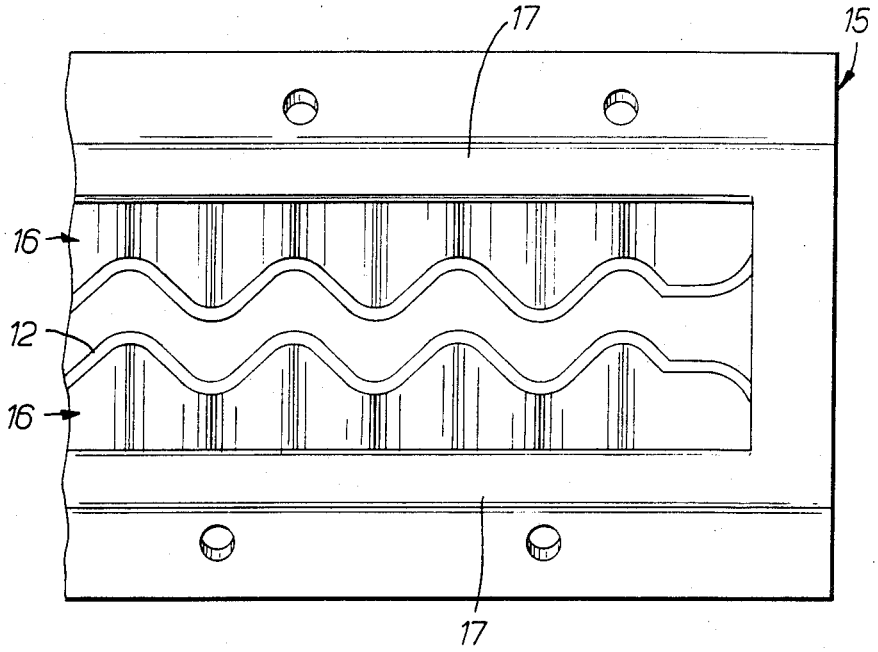
FIG. 5 is a scrap plan view of a razor in accordance with the invention, incorporating blades as shown in FIGS. 1 to 4.
Figure 6:
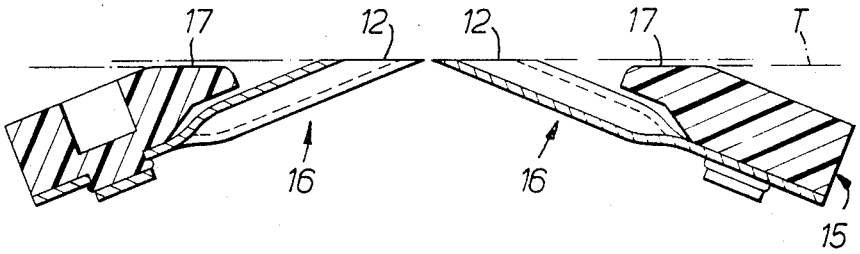
FIG. 6 is a cross-section of the head of the razor seen in FIG. 5.

In the opposed blade razor shown in FIGS. 5 and 6, the head of the razor comprises a moulded support 15 having the general form of an open rectangular frame. Two single edged blades 16 are secured to the underside of the support, the blades each having an undulating cutting edge formed, as described above, by corrugations 10 and substantially planar facets 12.

The undulating edges are directed towards each other with the peaks of one edge in register with the troughs of the opposite edge, across a gap of 1.25 mm, which is uniform along the lengths of the blade edges The upper surfaces 17 of the longitudinal sides of the support form skin engaging surfaces set in a common, notional tangent plane 'T'.

The blade facets 12 are set parallel to each other and to the tangent plane 'T', and are set above the plane 'T' by a distance of 0.05 mm.

It will be noted that the gap of 1.25 mm between the blade edges is considerably larger than would normally be acceptable for opposed edge razors having conventional, rectilinear edges, which would usually be not greater than about 0.75 mm.

Figure 7:
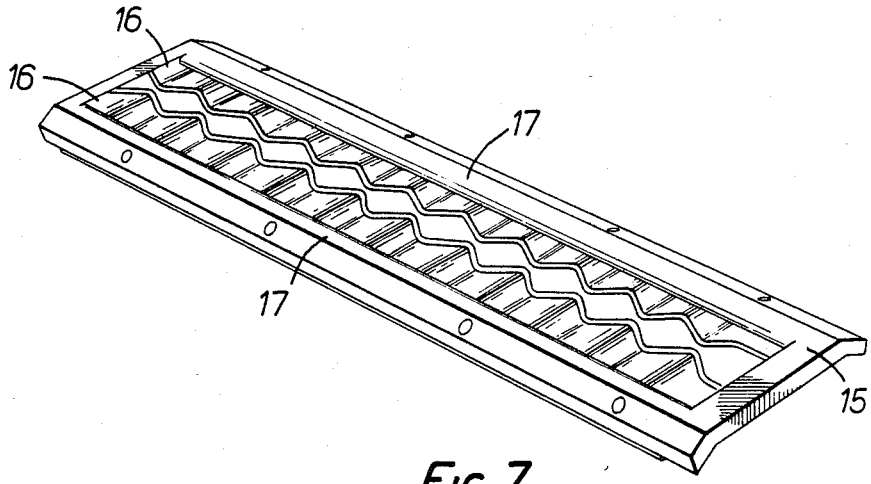
FIGS. 7 and 8 are a perspective view and cross-section, respectively, of a modified razor head or cartridge.
Figure 8:
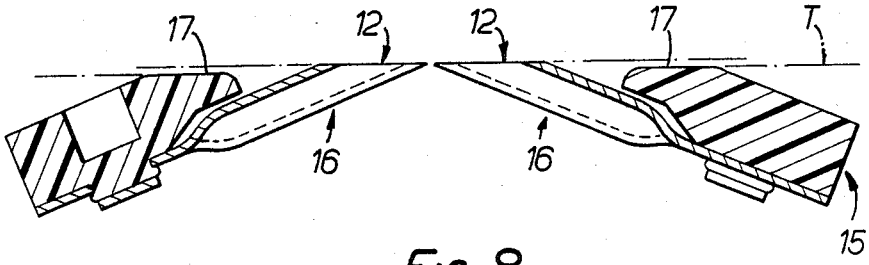

In the modified razor head shown in FIGS. 7 and 8, the only significant difference is that the two blades are positioned to have the peaks of the respective cutting edges directly opposite each other. This results in the gap between the blade edges being much larger across the troughs in the edges, but does not significantly increase the risk of the skin bulging unduly into those portions of the gaps since the skin is supported by the inclined flanks of the edges.

In the above described embodiment the two blade edges are identically formed, but it would of course be possible to employ two blades whose edge forms differ for example with respect to the pitch and/or depth of their corrugations.

Although the illustrated razors have skin engaging portions 17, these are not strictly necessary to protect the user against the blade edges digging into the skin but mainly serve to assist the user in maintaining a proper orientation of the razor head relative to the skin.

The above described heads may be formed as disposable cartridges for removable mounting on razor handles, either of elongate grip form or of blade form, or may be permanently united with the handles to form disposable razors.

Figure 9:
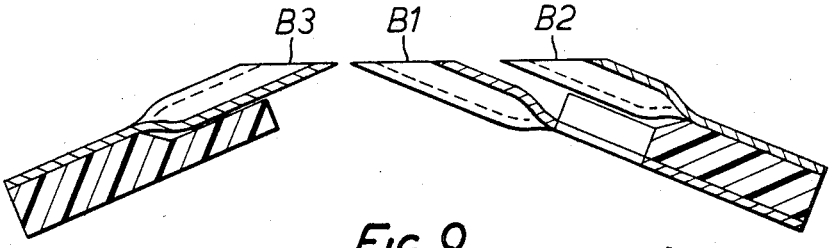
FIG. 9 is a cross-section of another form of razor head in accordance with the invention.

In another form of razor in accordance with the invention, illustrated in FIG. 9, the razor head takes the general form of a tandem blade head or cartridge incorporating two blades B1, B2 arranged with their cutting edges spaced apart to act in tandem upon the skin. However, the blades B1, B2 are both of the form described above, with the undulations of their respective blade edges in register with each other. Furthermore, the usual guard member of a conventional razor head is replaced by a third blade B3, of the same edge form as blades B1 and B2, having its cutting edge directed towards that of the leading blade B1 of the tandem pair, and its undulations opposite the troughs of the blade B1, i.e. so that a constant gap is left between the confronting edges.

This razor may be used conventionally, to shave with the tandem edges of blades B1 and B2, but may also be used, with a to and fro scrubbing action, with the blade B3 active in the reverse stroke, while the blades B1 and B2 act as skin guards.

Neither the guard nor the cap of a conventional razor are required, thanks to the substantial width of skin engaging facets of the array of blades.

I claim:

1. A safety razor comprising a pair of opposed blade means having respective sharpened cutting edges directed toward each other with a gap therebetween, each of said sharpened cutting edges being of undulating form so as to have alternating peaks and troughs, wherein each said blade means has a marginal edge portion formed with corrugations extending transversely to the length of the edge and a substantially planar facet intersecting said corrugations over the full depth thereof to define a continuous undulating sharpened cutting edge.

2. The safety razor of claim 1, wherein the said edges are of substantially identical form, and the peaks of one said edge are in registry with the troughs of the other.

3. The safety razor of claim 1, wherein the said edges are of substantially identical form, and the peaks of the respective edges are in registry with each other.

4. A safety razor comprising blade support means and a pair of opposed blade means having respective sharpened cutting edges directed toward each other across a gap defined by said edges, wherein each said blade means has a longitudinally extending marginal edge portion formed with a series of corrugations each extending traversely to the length of said edge portion and said blade means further comprises a substantially planar facet intersecting said corrugations over the full depth thereof to define a continuous undulating sharpened cutting edge, and wherein said facets of said respective edges are substantially coplanar with each other.

5. A safety razor comprising blade support means and a pair of opposed blade means having respective sharpened cutting edges directed toward each other across a gap defined by said edges, wherein each said blade means has a longitudinally extending marginal edge portion formed with a series of corrugations each extending transversely to the length of said edge portion and said blade means further comprises a substantially planar facet intersecting said corrugations over the full depth thereof to define an undulating sharpened cutting edge, and wherein said facets of said respective edge means are substantially coplanar with each other, said safety razor further including a third blade means set behind one of said opposed blade means to form a tandem pair therewith, said third blade means having a marginal edge portion and sharpened cutting edge substantially identical to one of said opposed blade means.

* * * * *